US007093906B1

(12) United States Patent
Davidson

(10) Patent No.: US 7,093,906 B1
(45) **Date of Patent: *Aug. 22, 2006**

(54) FLOOR SCRAPING MACHINE WITH FLOATING BLADE

(76) Inventor: Rex D. Davidson, 9600 Kickapoo Dr., Mustang, OK (US) 73064

( * ) Notice: Subject to any disclaimer, the term of this patent is extended or adjusted under 35 U.S.C. 154(b) by 0 days.

This patent is subject to a terminal disclaimer.

(21) Appl. No.: 11/132,009

(22) Filed: May 18, 2005

Related U.S. Application Data

(63) Continuation of application No. 10/027,460, filed on Dec. 21, 2001, now Pat. No. 6,988,776.

(51) Int. Cl.
*B32B 31/18* (2006.01)

(52) U.S. Cl. ..... 299/36.1; 299/75; 30/170; 15/93.1

(58) Field of Classification Search ..... 299/36.1, 299/37.1, 75; 30/170; 15/93.1; 172/821
See application file for complete search history.

(56) References Cited

U.S. PATENT DOCUMENTS

| | | | | |
|---|---|---|---|---|
| 2,943,407 | A * | 7/1960 | Long | 172/821 |
| 3,631,930 | A * | 1/1972 | Peterson | 172/821 |
| 3,648,782 | A * | 3/1972 | Mazzarins | 172/821 |
| 3,674,096 | A * | 7/1972 | Berg | 172/821 |
| 3,690,386 | A * | 9/1972 | Magee | 172/821 |
| 4,053,958 | A | 10/1977 | Taylor | |
| 4,270,617 | A * | 6/1981 | Cantarella et al. | 172/821 |
| 4,405,019 | A | 9/1983 | Frisbee | |
| 4,815,542 | A | 3/1989 | DePlazes | |
| 4,986,377 | A | 1/1991 | Moriarty | |
| 5,409,299 | A | 4/1995 | Holder | |
| 5,641,206 | A | 6/1997 | Craft | |
| 5,772,284 | A | 6/1998 | Lindsey et al. | |
| 6,343,981 | B1 * | 2/2002 | Buchanan | 451/350 |
| 6,523,906 | B1 * | 2/2003 | Holder | 299/36.1 |

FOREIGN PATENT DOCUMENTS

| | | | |
|---|---|---|---|
| GB | 2037848 | * | 7/1980 |

OTHER PUBLICATIONS

"Tractor Types", Tractors and their Power Units, pp. 4-13, published 1951.

* cited by examiner

*Primary Examiner*—Sunil Singh
(74) *Attorney, Agent, or Firm*—Frank J. Catalano

(57) ABSTRACT

A machine for scraping a floor covering from a floor has rear drive wheels and a forward blade assembly. Arms which each rotate independently on the frame at one end are connected to the blade assembly which independently rotate on their other ends. Thus, the blade is able to float and follow the contour of the floor even if the wheels and blade are riding on an uneven surface. The pitch and elevation of the blade assembly can be changed individually or simultaneously without inhibiting the floating motion of the blade assembly.

2 Claims, 4 Drawing Sheets

FLOOR SCRAPING MACHINE WITH FLOATING BLADE

This application is a continuation of application Ser. No. 10/027,460, filed Dec. 21, 2001, now U.S. Pat. No. 6,988, 776.

BACKGROUND OF THE INVENTION

This invention relates generally to floor preparation machines and more particularly concerns machines for scraping floor coverings from a base floor surface.

Scraping machines for removing old carpet, tile and other floor coverings from concrete floors consist essentially of a frame with rear end drive wheels and a front end blade. These machines generally use an hydraulic drive system. On some machines the hydraulic drive system is also used to raise and lower the blade or to change the pitch of the blade.

On older machines, the blade is fixed to the frame. If irregularities in or unevenness of the floor alter the attitude of the machine, the blade attitude also changes, causing the blade to partially or completely shear the covering and ride above it. It is then necessary to back up the machine and restart the scraping process.

On newer machines, the blade is permitted to roll on a longitudinal shaft fixed to the frame. Thus, when an irregularity or unevenness of the floor occurs at the blade, the blade rolls about the fixed axis of the shaft to somewhat maintain contiguous relationship of the blade with the floor. However, since the roll axis is fixed relative to the frame, when the irregularity or unevenness of the floor is encountered by the drive wheels, the changed machine attitude also changes the roll axis alignment. The blade edge does not adequately conform to the floor contour because the roll axis is not perpendicular to the vertical plane passing through the blade edge. Therefore, the blade will still shear and ride above the covering.

It is, therefore, an object of this invention to provide a floor scraping machine which is able to maintain continuous relationship with the floor when the machine attitude does not conform to the floor contour at the blade edge. Another object of this invention is to provide a floor scraping machine which has a blade which does not have a fixed roll axis. A further object of this invention is to provide a floor scraping machine which has a blade which is able to float in relation to the machine frame. Yet another object of this invention is to provide a floor scraping machine which has a floating blade which can also be raised and lowered relative to the floor. It is also an object of this invention to provide a floor scraping machine which has a floating blade which can also be pitch adjusted.

SUMMARY OF THE INVENTION

In accordance with the invention, a machine is provided for scraping a floor covering from a base floor surface. The machine frame has a longitudinal reference axis which is fixed in relation to the frame. Left and right drive wheels support the rear of the frame above the floor. The wheels are oriented to propel the frame across the floor in a direction parallel to the frame reference axis. Left and right arms are journalled on the frame for independent rotation about an axis transverse to the reference axis. A blade assembly has a floor scraping edge which extends transverse to the reference axis. The blade assembly is pivotally connected to the left and right arms for independent rotation on blade assembly axes which are transverse to the reference axis. Thus, the blade is able to follow the contour of the floor even if the wheels and blade do not simultaneously encounter the same irregularities in or unevenness of the floor.

The machine may also have a yoke with left and right ends of the yoke pivotally connected to the left and right arms. The yoke ends independently rotate on axes parallel to the reference axis. A piston and cylinder are provided for raising and lowering the yoke between a lower floor scraping position and a higher storage position. The piston and cylinder are pivotally connected at one end to the frame for rotation about an axis transverse to the reference axis and pivotally connected at the other end to the yoke for rotation about an axis parallel to the reference axis. The ability of the yoke to rotate at its ends relative to the arms and the bidirectional rotational capability of the piston and cylinder relative to the frame and yoke assures that the yoke does not inhibit the independent rotation of the arms.

The machine may also have left and right pistons and cylinders, each pivotally connected at one end to their corresponding arms and pivotally connected at their other end to the blade assembly. The pivots allow rotation about axes transverse to the reference axis so as to vary the pitch of the blade assembly.

BRIEF DESCRIPTION OF THE DRAWINGS

Other objects and advantages of the invention will become apparent upon reading the following detailed description and upon reference to the drawings in which.

Figure 2:
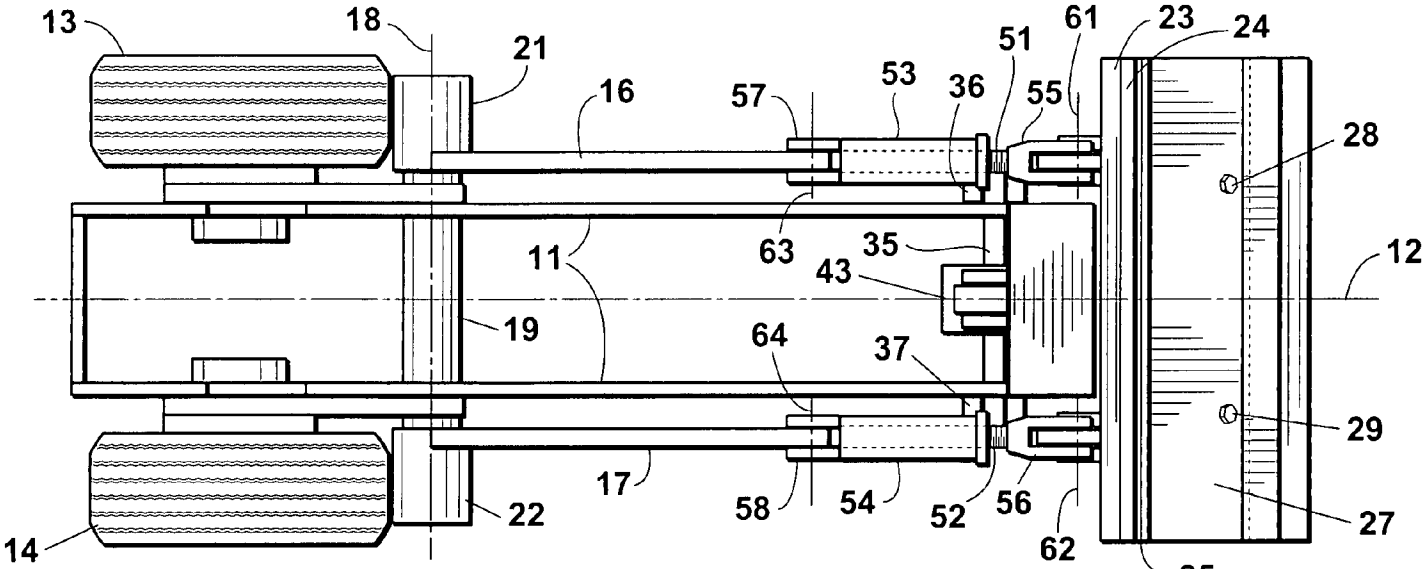
FIG. 2 is a top plan view of the machine of FIG. 1.
Figure 1:
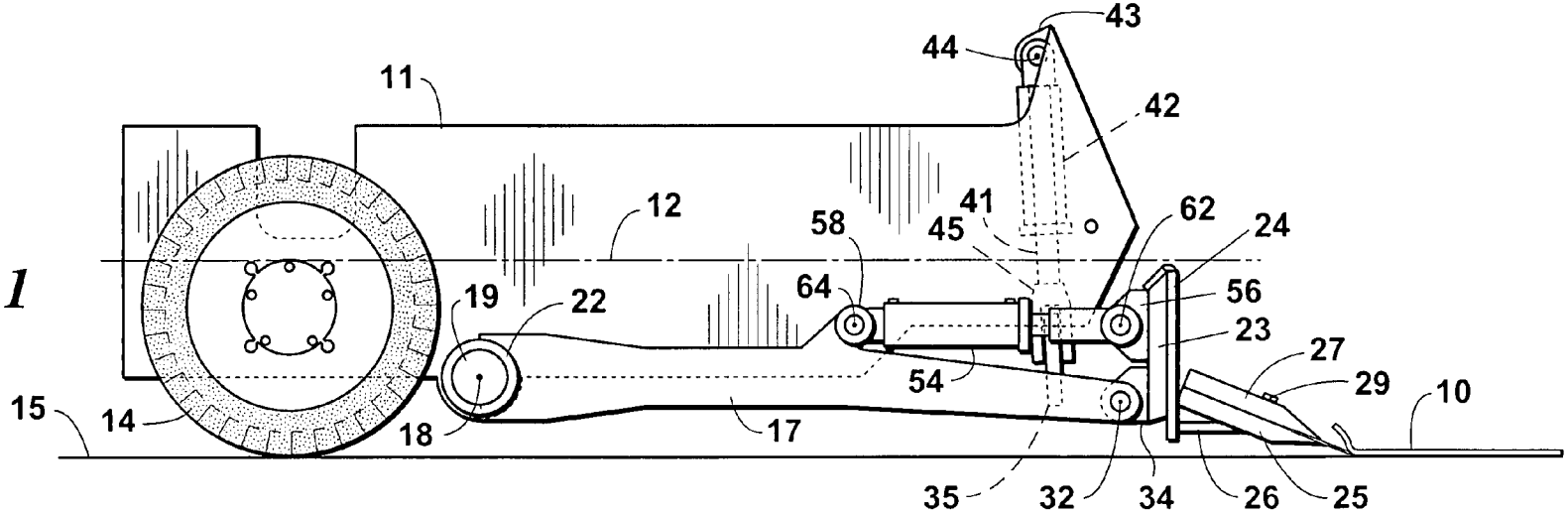
FIG. 1 is a right side elevation view of a preferred embodiment of a floor scraping machine with a floating blade.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Turning first to FIGS. 1 through 4, a preferred embodiment of a machine for scraping a floor covering from a base floor surface is illustrated. The machine has a frame 11 which extends along a longitudinal reference axis 12 which is fixed in relation to the frame 11. The axis 12 is designated for reference purposes only so as to facilitate understanding the operation of the invention. Left and right drive wheels 13 and 14 support the rear of the frame 11 above the floor 15. The wheels 13 and 14 are oriented to propel the frame 11 across the floor 15 in a direction parallel to the reference axis 12. Left and right radial arms 16 and 17 extend along the left and right sides of the frame 11. The rear ends of the arms 16 and 17 are journalled for independent rotation about an axis 18 which is transverse to the reference axis 12. As shown, a pivot axle 19, such as a three inch round steel bar, is welded to the frame 11 forward of the left and right wheels 13 and 14. Left and right axle bushings 21 and 22, such as four inch outer diameter by three inch inner diameter steel sleeves, are mounted for rotation on the ends of the axle 19 and about the axis 18. The axle 19 is fixed and the bushings 21 and 22 are free to rotate independently on the axle 19. The left and right arms 16 and 17 are welded to their respective bushings 21 and 22 so that the arms 16 and 17 are free to rotate about the axis 18 independently of the motion of the frame 11.

Figure 3:
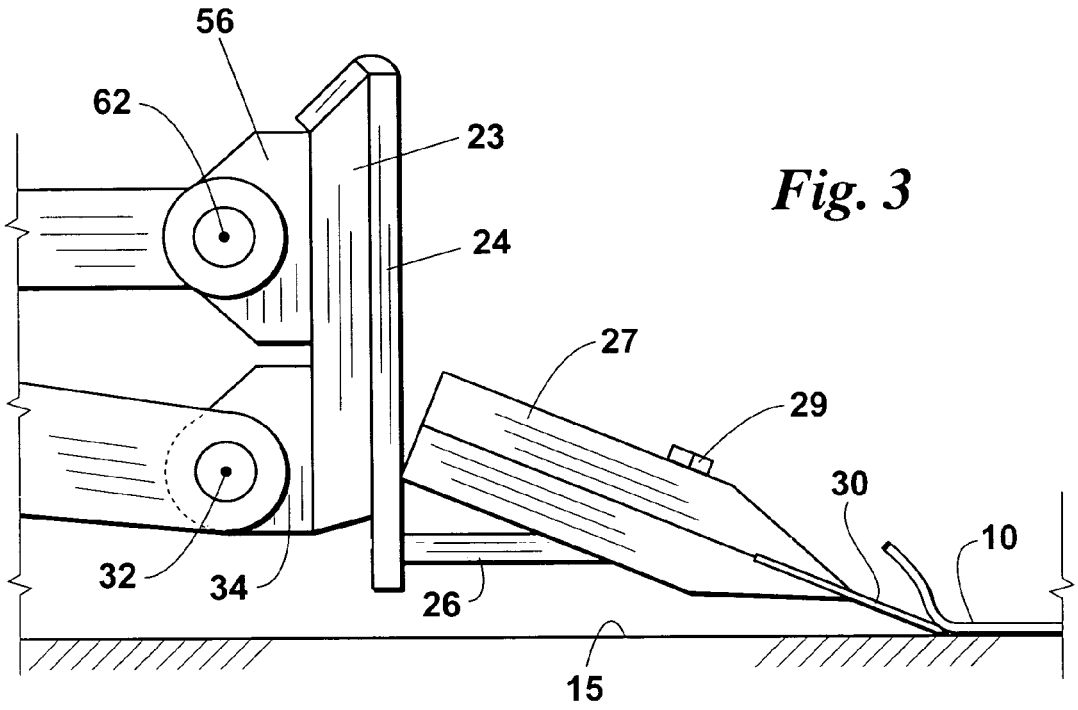
FIG. 3 is an exploded right side elevation view of the blade assembly of the machine of FIG. 1.

A blade assembly includes a blade attachment bar 23 which extends across the width of the machine. A blade holding bar 24 is detachably mounted across the front of the blade attachment bar 23 by use of bolts (not shown). This permits the blade assembly to be detached from the machine, either to change the blade assembly or to permit the machine to be used for purposes other than floor scraping. A blade mount bottom 25 and brace member 26 are welded to the blade holding bar 24. A blade mount top 27 is removably secured against the blade mount bottom 25 by bolts 28 and 29 so that the blade 30 can be easily installed or removed. As best seen in FIG. 3, the blade assembly grips the blade 30 between the blade mount bottom 25 and blade mount top 27 so that the secured edge of the blade 30 rides against a shoulder on the blade mount bottom 25 while the exposed edge of the blade 30 rides against the base floor 15 to scrape the covering 10 from the floor.

The blade assembly is pivotally connected to the forward ends of the left and right arms 16 and 17 for independent rotation on blade assembly axes 31 and 32 which are transverse to the reference axis 12. As shown, devices 33 and 34 on left and right sides of the blade attachment bar 23 pivotally receive the forward ends of the left and rights arms 16 and 17, respectively. The independent pivoting action of the rear ends of the arms 16 and 17 in relation to the axis 18 of the pivot axle 19 together with the independent rotation of the devices 33 and 34 on the forward ends of the arms 16 and 17 permit the blade assembly to maintain an attitude in conformance to the contour of the floor 15 at the floor scraping edge of the blade 30 whether or not the contour of the floor 15 at the drive wheels 13 and 14 is on an even plane with the scraping edge. In other words, the blade assembly which extends transverse to the reference axis 12 does not roll in relation to a fixed axis on the machine but floats, the opposite sides of the blade assembly being free to ride up and down independently of the machine attitude to conform the scraping edge to the contour of the floor 15.

Figure 4:
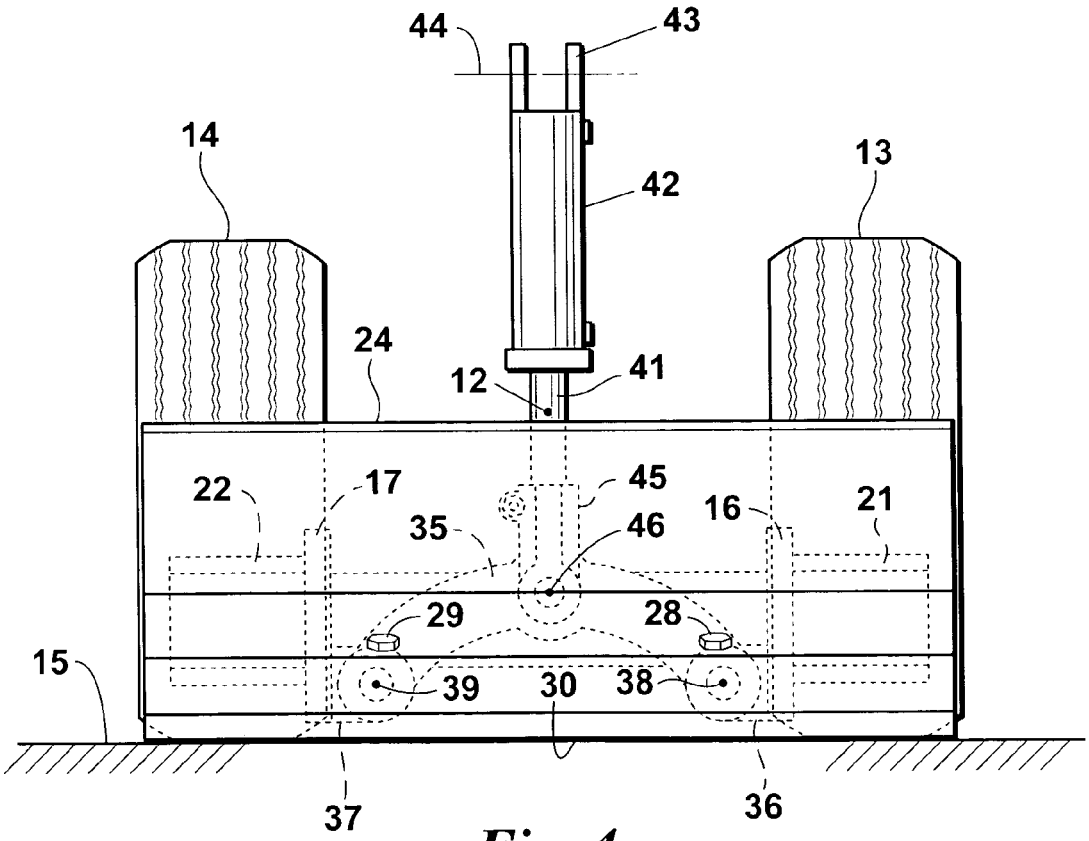
FIG. 4 is a front elevation view of the machine of FIG. 1 with the blade and wheels traveling on a level floor.

To facilitate raising and lowering the blade assembly between a lower floor scraping position and a higher storage position, a yoke 35 connects the forward portions of the left and right arms 16 and 17. Clevices 36 and 37 pivotally engage the left and right ends of the yoke 35. As best seen in FIG. 4, the devices 36 and 37 permit the ends of the yoke 35 to independently rotate on axes 38 and 39 which are parallel to the reference axis 12. The independent rotation of the ends of the yoke 35 on the devices 36 and 37 allows the arms 16 and 17 to maintain their independence in rotation about the axis 18 while providing a cross member which can be used to raise and lower the arms 16 and 17 simultaneously. To accomplish this, a piston 41 and cylinder 42 are pivotally connected at an upper end to the frame 11 and at a lower end to the yoke 35. As shown, a clevis 43 on the end of the cylinder allows rotation about an axis 44 transverse to the reference axis 12 and a clevis 45 at the end of the piston 41 allows rotation about an axis 46 parallel to the reference axis 12. The ability of the yoke to rotate with respect to the longitudinal axis 46 and the piston 41 and cylinder 42 to rotate in relation to the transverse axis 44 affords the benefit of a lift mechanism for transferring the blade assembly between the scraping and storage positions without inhibiting the floating characteristic of the blade assembly.

The machine may also be provided with left and right pistons 51 and 52 and cylinders 53 and 54 for varying the pitch of the blade assembly. As shown, the pistons 51 and 52 are connected to the blade assembly by devices 55 and 56 and the cylinders 53 and 54 are connected to midportions of the left and right arms 16 and 17, respectively, by devices 57 and 58. The devices 55 and 57 and 56 and 58 allow rotation of the blade assembly about axes 61 and 62 transverse to the reference axis 12 and of the pistons and cylinders 51 and 53 and 52 and 54 about axes 63 and 64 transverse to the reference axis 12 so that operation of the pistons 51 and 52 will change the pitch of the blade assembly.

Figure 5:
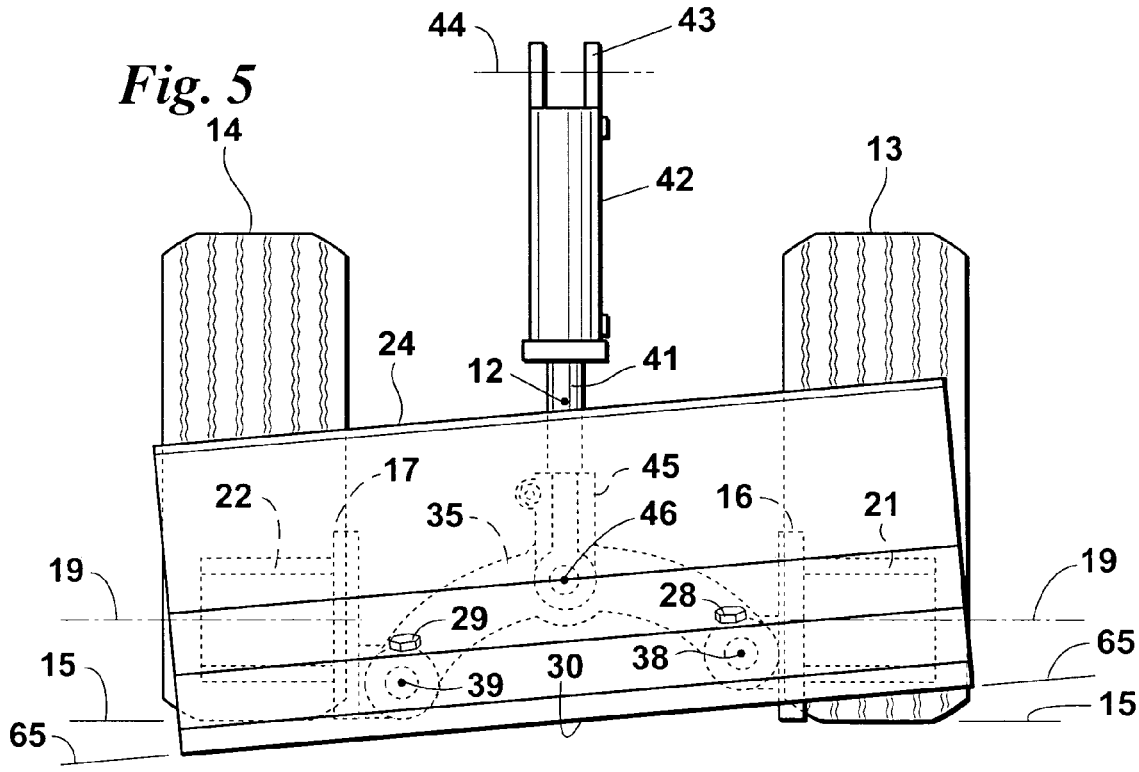
FIG. 5 is a front elevation view of the machine of FIG. 1 with the blade traveling on an uneven floor.
Figure 6:
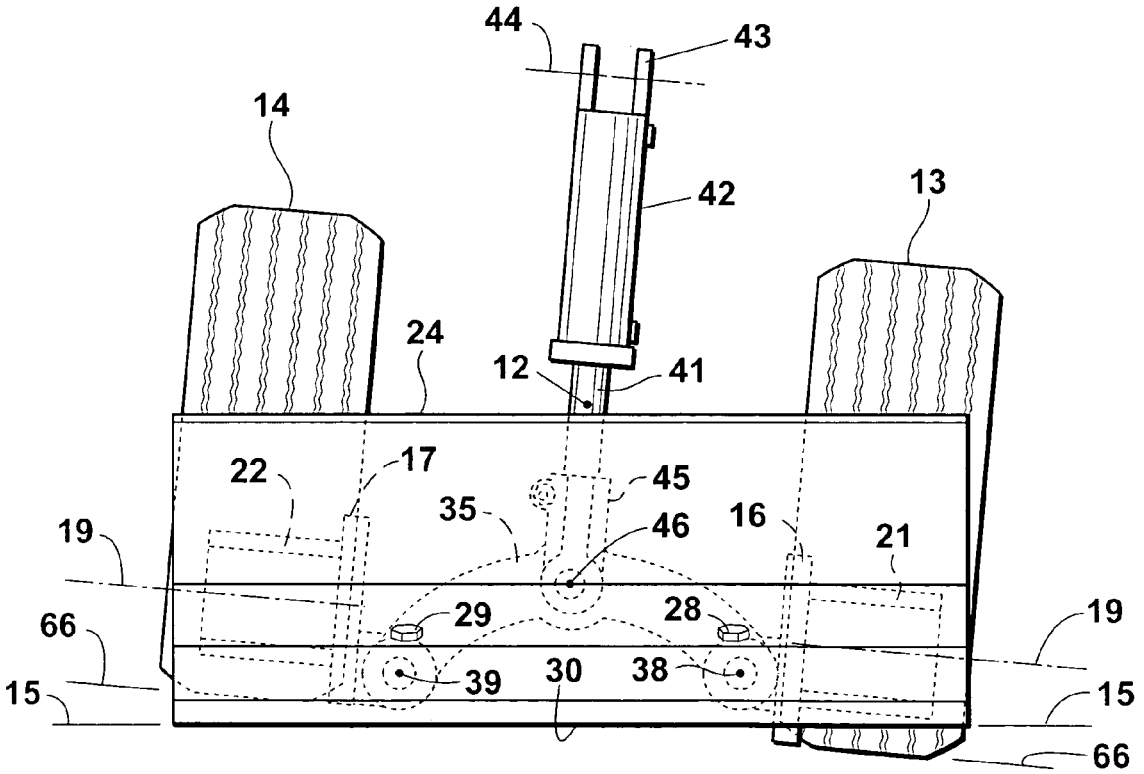
FIG. 6 is a front elevation of the machine of FIG. 1 with the machine wheels encountering an irregularity, unevenness or obstruction.

Looking at FIG. 4, the orientation of the machine is seen in relation to an even floor 15. When operating under such ideal conditions, the drive wheels 13 and 14 are substantially perpendicular to the floor 15 and the blade assembly rides substantially parallel to the floor 15. Looking at FIG. 5, when the drive wheels 13 and 14 are on even floor 15 but the scraping edge of the blade 30 encounters uneven floor 65, the rotation of the arms 16 and 17 in relation to the transverse axis 19 and the freedom of the yoke 35 to rotate on the axes longitudinal 38 and 39 allow the blade assembly to float and conform its position to the uneven floor 65. Similarly, looking at FIG. 6, when the blade assembly is contoured to an even floor 15, but the drive wheels 13 and 14 encounter an uneven floor 66, the wheels 13 and 14 and therefore the machine assume an attitude which is not perpendicular to the even floor 15. Once again, however, the independent freedom of the arms 16 and 17 to rotate about the transverse axis 19 and the ends of the yoke 35 to rotate about longitudinal axes 38 and 39 allow the blade assembly to float and maintain its contour to the even floor 15 even though the machine attitude is conformed to the uneven floor 66. The principles above explained apply to the operation of the machine, regardless of whether the irregularities or obstructions in or on the floor 15 are presented to the blade assembly, to either of the drive wheels 13 and 14 or to any combinations of them.

Figure 7:
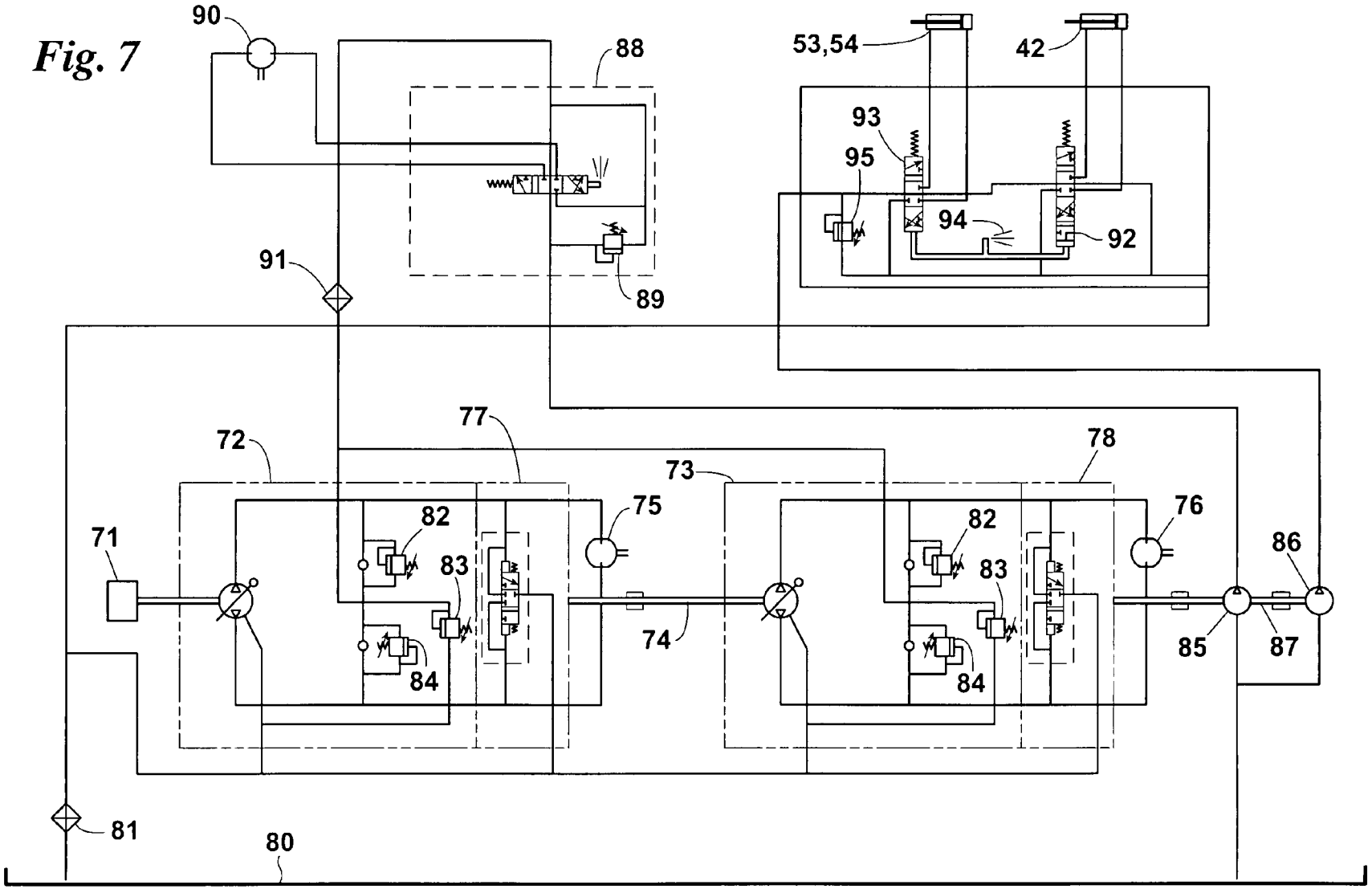
FIG. 7 is a schematic diagram of the preferred hydraulic system of the machine of FIG. 1.

The machine hydraulic system is illustrated in FIG. 7. An engine 71 drives left and right two directional pumps 72 and 73 tied by a shaft 74. The pumps 72 and 73 drive left and right reversible drive motors 75 and 76 for the machine left and right drive wheels 13 and 14. Left and right three position oil operated exchange valves 77 and 78 are connected between the pumps and reversible motors 72 and 75 and 73 and 76. The exchange valves 77 and 78 divert a portion of the fluid, perhaps 1 to 2 gpm, into low pressure cooling. Fluid is passed through a cooler 81 before returning to the reservoir 80. In the prototype device a 3400 rpm engine 71 was used with 17 gpm two directional piston pumps 72 and 73 with cross over relief valves 82, 83 and 84 at 2500 psi, 200 psi and 2500 psi, respectively. A fifteen gallon reservoir was used.

The hydraulic system controls include two unidirectional gear pumps 85 and 86 tied by shaft 87. One gear pump 85 is connected to a lever operated three position directional control valve 88 permitting selection of clockwise or counter-clockwise rotation of an auxiliary motor 90 which may be included to permit adaptation of the machine to optional non-scraping equipment, such as a grinder. Fluid flows from the gear pump 85 to the three position valve 88 which feeds the accessory motor 90 and then passes through the filter 91 to the drive pumps 72 and 73. Thus, the pressure of the gear pump 85 is divided across the drive pumps 72 and 73 for use as a charge flow or pressure supply to the drive pumps 72 and 73. The other gear pump 86 is connected to a four position directional control valve 92 and a three position directional control valve 93. These valves are operated by a common joy stick 94 so that one or both spools may be operated simultaneously. The four position valve 92 controls the operation of the blade lift cylinder 42 and the three position valve 93 controls the operation of the blade pitch cylinders 53 and 54. Using the joy stick 94, the operator can independently or simultaneously raise and lower the blade and/or change the blade pitch. This system is also protected by a relief valve 95. The lift cylinder 42 can be raised, lowered, locked or permitted to float to allow the blade 30 to float on the floor 15. In the prototype machine, the drive wheel control pump 85 is a 14 gpm unidirectional gear pump and the blade lift and pitch control pump 86 is a 3 gpm double pair pump.

Thus, it is apparent that there has been provided, in accordance with the invention, a machine for scraping a floor covering from a base floor that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A machine for scraping a floor covering from a base floor surface comprising:

a machine frame having a longitudinal reference axis which is fixed in relation to said frame;

left and right drive wheels supporting a rear of said frame above the floor and oriented to propel said frame across the floor in a direction parallel to said reference axis;

left and right arms journalled on said frame for independent rotation of said arms about an axis transverse to said reference axis; and a blade assembly having a floor scraping edge, said assembly being pivotally connected to forward ends of said left and right arms and supporting a front of said frame above the floor.

2. A machine according to claim 1 further comprising left and right pistons and cylinders for varying a pitch of said blade assembly, said pistons and cylinders being pivotally connected at rear ends thereof to midportions of said left and right arms, respectively, and being pivotally connected at forward ends thereof to said blade assembly for rotation about axes transverse to said reference axis.

* * * * *